United States Patent [19]

Fukui et al.

[11] Patent Number: 5,054,447

[45] Date of Patent: Oct. 8, 1991

[54] IGNITION TIMING CONTROL DEVICE AND METHOD FOR AN INTERNAL COMBUSTION ENGINE

[75] Inventors: Wataru Fukui; Toshio Iwata, both of Himeji, Japan

[73] Assignee: Mitsubishi Denki Kabushiki Kaisha, Tokyo, Japan

[21] Appl. No.: 603,352

[22] Filed: Oct. 26, 1990

[30] Foreign Application Priority Data

Oct. 30, 1989 [JP] Japan ..... 1-279932

[51] Int. Cl.[5] ..... F02P 5/15

[52] U.S. Cl. ..... 123/414; 123/418; 123/419

[58] Field of Search ..... 123/422, 423, 419, 418, 123/414

[56] References Cited

U.S. PATENT DOCUMENTS

| | | | |
|---|---|---|---|
| 4,498,438 | 2/1985 | Sato | 123/418 |
| 4,627,399 | 12/1986 | Yoshida et al. | 123/419 |
| 4,688,535 | 8/1987 | Küttner et al. | 123/419 |
| 4,747,383 | 5/1988 | Kimura et al. | 123/422 |
| 4,951,628 | 8/1990 | Matsuoka et al. | 123/414 |
| 4,996,958 | 3/1991 | Iwata et al. | 123/418 |

FOREIGN PATENT DOCUMENTS

| | | | |
|---|---|---|---|
| 60-60273 | 4/1985 | Japan | 123/418 |
| 61-244869 | 10/1986 | Japan | 123/419 |
| 63-186967 | 8/1988 | Japan . | |
| 64-77736 | 1/1989 | Japan . | |
| 1-193079 | 8/1989 | Japan | 123/418 |
| 2-81956 | 3/1990 | Japan | 123/418 |

*Primary Examiner*—Andrew M. Dolinar

*Attorney, Agent, or Firm*—Sughrue, Mion, Zinn, Macpeak and Seas

[57] ABSTRACT

An ignition timing control device for a multicylinder engine comprises a position sensor which generates a crank angle reference position signal indicative of a first and a second reference position of respective cylinders, wherein the second reference position of a particular cylinder is retarded by a predetermined offset with respect to other cylinders. Thus, the control device discriminates the particular cylinder from the ratio of the pulse-width to the pulse repetition period. The length of time between the first or second reference position and the target ignition timing is determined in accordance with the average of two or more preceding periods between the first or second reference position. Thus, the error of the ignition timing, which results from a hunting of the rpm of the engine and which is especially conspicuous with respect to the particular cylinder, is suppressed.

5 Claims, 7 Drawing Sheets

IGNITION TIMING CONTROL DEVICE AND METHOD FOR AN INTERNAL COMBUSTION ENGINE

BACKGROUND OF THE INVENTION

This invention relates to a control device and method for controlling ignition timings of an internal combustion engine, and more particularly to such a control device and method wherein a single crank angle reference signal is utilized both for the cylinder control timing determination and the cylinder discrimination.

Microcomputers are now commonly used for controlling the operational timings of internal combustion engines. The microcomputer receives, in addition to operation condition signals from various sensors, position signals generated in synchrony with the rotation of the engine, and thereby determines the operational position of each cylinder. The position signals corresponding to the reference crank angles of respective cylinders are generated by a signal generator which detects the rotation of the cam shaft or the crank shaft of the engine.

FIG. 3 is a block diagram showing a typical organization of a control device of an internal combustion engine. A rotation signal generator 8 generates a position signal L consisting of a train of pulses rising and falling at predetermined crank angles of respective cylinders. Various sensors 20 output operational condition signals D representing the load (acceleration) state, velocity, temperature, etc. These signals L and D are inputted via an interface circuit 9 to a microcomputer 10. In response thereto, the microcomputer 10 comprising a ROM 11 and a RAM 12 controls the fuel injection and the ignition timings. The ignition circuit for each cylinder of the engine comprises an ignition coil 14, a switching transistor 15 coupled to the primary side of the ignition coil 14, and a spark plug 16 coupled to the secondary side of the ignition coil 14. An output of the microcomputer 10 is coupled via an interface 13 to the base of the transistor 15, and interrupts the primary current of the ignition coil 14 at proper ignition timings to generate a spark across the spark plug 16

FIG. 4 shows an example of the rotation signal generator 8, and FIG. 5 shows the circuit organization thereof. A disk 2, mounted on top of a shaft 1 rotating in synchrony with the crank shaft of the engine, has elongated windows 3*a* and 3*b* extending along the circumference of the disk 2. FIG. 4 shows the case where the engine comprises four cylinders, No. 1 through No. 4, wherein window 3*b* corresponds to cylinder No. 1 (the particular cylinder which is to be discriminated, as described below) and the other three windows 3*a* correspond to cylinders Nos. 2 through 4. The front ends of the windows 3*a* and 3*b* correspond to first reference position (e.g., 75 degrees before top dead center, or B75°) of respective cylinders, while the rear ends of the windows 3*a* and 3*b* correspond to the second reference positions of respective cylinders. The second reference position of the cylinders No. 2 through 4 is 5 degrees before top dead center (B5°), for example. However the second reference position of the cylinder No. 1 (the particular cylinder) is retarded than that of other cylinders, and is equal, for example, to 5 degrees after top dead center (A5°).

A light emitting diode 4 and a photodiode 5 together constitute a photocoupler. The light emitted from the light emitting diode 4 is received via the windows 3*a* and 3*b* by the photodiode 5. The output of the photodiode 5 is supplied via an amplifier 6 to the base of an output transistor 7 with a grounded emitter, whose open collector terminal outputs the position signal L.

The method of operation of the conventional control device of an engine shown in FIGS. 3 through 5 is as follows.

FIG. 6 shows the waveform of the position signal L, which consists of a train of pulses which rise and fall at first and second reference crank angles of respective cylinders, as indicated in the figure. The leading edge of each pulse corresponds to the first reference position, 75 degrees before top dead center (B75°). The trailing edge of the pulses corresponds to the second reference position, which is equal to 5 degrees before top dead center (B5°), in the case of cylinders No. 2 through 4, but is 5 degrees after top dead center (A5°), in the case of cylinder No. 1, the particular cylinder. Thus, the particular cylinder (cylinder No. 1) can be discriminated from other cylinders from the ratio of the pulse-width to the pulse-repetition period T.

Thus, on the basis of the pulse-width to pulse-period ratios of the position signal L, the microcomputer 10 discriminates the particular cylinder, cylinder No. 1, and thereby determines the successive order of the cylinders. The ignition timings of respective cylinders are determined with reference to either the first or the second reference crank angle, as described below. Further, in response to the operation condition signals D, the microcomputer 10 reads out the optimal control values stored in the ROM 11, and determines, in accordance with the control program stored in the RAM 12, the optimal target ignition timings.

As shown in FIG. 7, the ignition timing $\theta x$ is usually set with respect to the first reference position B75°. Thus, the microcomputer 10 calculates, at each first reference position B75°, the length of time Tx between the reference position B75° and the target ignition position $\theta x$, from the values of the preceeding pulse repetition period $T_{n-1}$ and the optimal target position $\theta x$. This is calculated as follows:

$$Tx=(\theta x-B75^\circ)\times T_{n-1}/180 \quad (1)$$

However, when the time length Tx between the first reference position B75° and the ignition timing $\theta x$ become longer, the precision of the control is deteriorated. Thus, in the case where the ignition control position is shifted toward the retard side and occurs later than the second reference position B5°, as indicated by $\theta x'$ in FIG. 7, the microcomputer 10 calculates, at each second reference position B5°, the length of time Tx' between the second reference position B5° and the target position $\theta x'$ as follows:

$$Tx'=(\theta x'-B5^\circ)\times T_{n-1}/180, \quad (2)$$

such that the time length Tx' between the reference and the control position becomes shorter. The microcomputer 10 sets the time length Tx or Tx' in the timer within the MPU thereof, such that the ignition signal is generated at the target ignition timing.

Thus, in the case where the ignition timing is determined with respect to the first reference position B75°, The microcomputer 10 executes an interrupt routine at B75° as shown in FIG. 8:

First, at step S1, the preceeding pulse repetition period $T_{n-1}$ (corresponding to 180° rotation of the crank shaft) of the position signal L between the leading edges of the previous and current pulses (see FIG. 7) is determined.

Next, at step S2, the length of time Tx between the reference position B75° and the target ignition position θx is determined from the values of the preceeding pulse repetition period $T_{n-1}$ and the target position θx as follows:

$$Tx=(\theta x-B75^\circ)\times T_{n-1}/180$$

The value of Tx is set in a timer within the microcomputer 10, such that the transistor 15 is turned off at the target position and the associated cylinder is ignited at the target point θx.

The above conventional control device has the following disadvantage: As described above, when the target ignition position θx is retarded than the second reference position, it is desirable to determined the ignition timing with respect thereto. However, since the second reference position A5° of the particular cylinder is retarded than that of the other cylinders (B5°), the second reference position A5° thereof cannot be used as the reference with respect to the particular cylinder when the target ignition position is advanced than A5°. Thus, when the pulse repetition period T undergoes hunting and goes up and down alternately as shown in FIG. 9, the control error from the target ignition position of the particular cylinder become especially conspicuous as shown by the solid curve in FIG. 10. This is due to the fact that the time length Tx as defined above with respect to the particular cylinder is greater than the time length Tx' from the second reference position with respect to other cylinders.

SUMMARY OF THE INVENTION

It is therefore a primary object of this invention to provide an ignition timing control device for an internal combustion engine, by which the control precision is not deteriorated even when the rpm of the engine undergoes hunting. In particular, this invention aims at providing such a control device which utilize a single crank angle reference position signal both for discriminating a particular cylinder and for determining reference crank angle positions of respective cylinders.

The above objects are accomplished in accordance with the principle of this invention by a control device for a multi-cylinder internal combustion engine, comprising: a signal generator means for generating a position signal indicative of a crank angle reference position of respective cylinders of the multi-cylinder internal combustion engine; a period determining means, coupled to an output of said signal generator means, for determining a period between successive reference positions of respective cylinders; a memory means, coupled to said period determining means, for storing a period determined previously by the period determining means; an averaging means, coupled to said period determining means and said memory means, for taking an average of a period as determined by the period determining means and a period stored in the memory means; an updating means, coupled to said period determining means and said memory means, for updating the period stored in said memory means to the period lastly determined by the period determining means, each time after the average means takes said average; an ignition timing determining means, coupled to said averaging means, for determining, at each reference position of each cylinder, a length of time from the reference position to a target ignition timing in accordance with the average of the periods as determined by the averaging means; and an ignition control means, coupled to said ignition timing determining means, for igniting said cylinder in accordance with the length of time from the reference position as determined by the ignition timing determining means.

Preferably, the signal generator means generates a position signal indicative of a first and a second reference position of respective cylinders, and the second reference position of a particular cylinder has a retarding offset with respect to the second reference position of other cylinders, the control device discriminating the particular cylinder by means of said offset, wherein said period determining means determines a period between successive first reference positions or between successive second reference positions of respective cylinders.

Alternatively, the above objects are accomplished in accordance with the principle of this invention by a control method for an internal combustion engine, comprising the steps of: (a) determining a period between successive first or second reference positions of respective cylinders; (b) taking an average of at least two preceding periods as determined at step (a); (c) determining, at each first or second reference position of each cylinder, a length of time from the first or the second reference position to a target ignition timing in accordance with the average of periods as determined at step (b); and (d) igniting each cylinder in accordance with the length of time from the first or the second reference position as determined at step (c).

BRIEF DESCRIPTION OF THE DRAWINGS

The novel features which are believed to be characteristic of this invention are set forth with particularity in the appended claims. This invention itself, however, both as to its organization and method of operation, together with further objects and advantages thereof, may best be understood from the detailed description of the preferred embodiments, taken in connection with the accompanying drawings, in which:

In the drawings, like reference numerals represent like or corresponding parts.

DETAILED DESCRIPTION OF THE PREFERRED EMBODIMENTS

Figure 3:
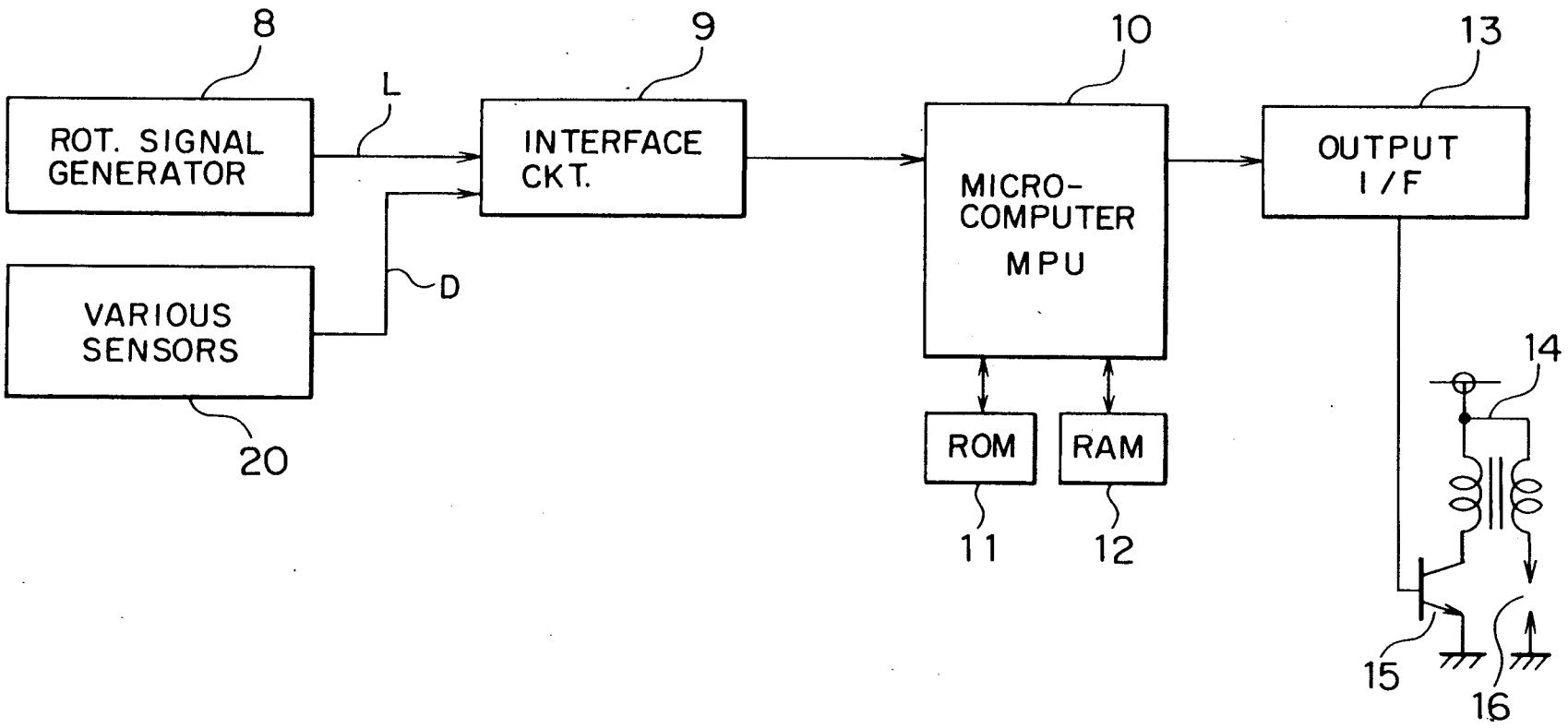
FIG. 3 is a block diagram showing the overall organization of the control device for an internal combustion engine according to this invention.
Figure 4:
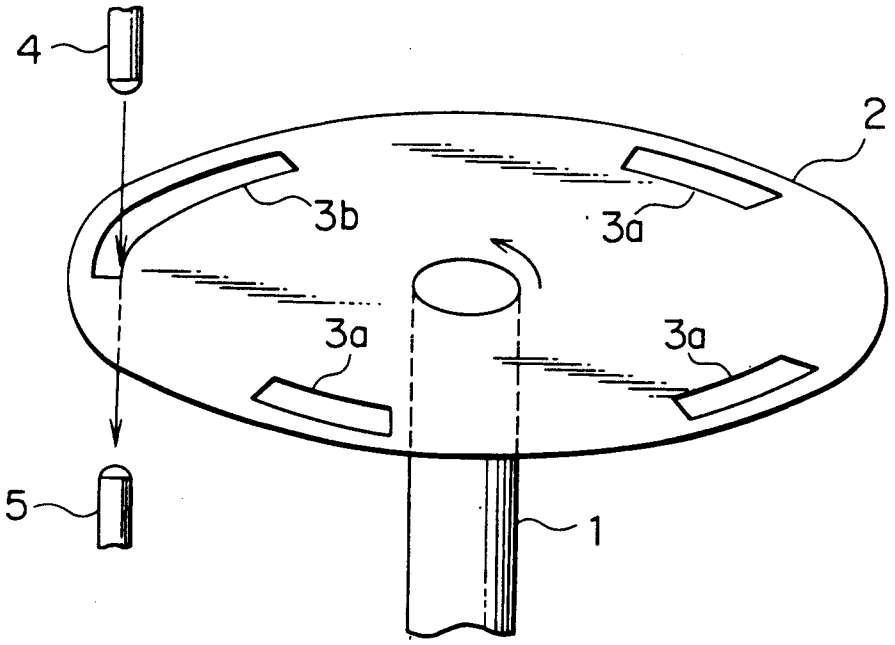
FIGS. 4 and 5 show the organization of a signal generator of the control device of FIG. 3.
Figure 5:
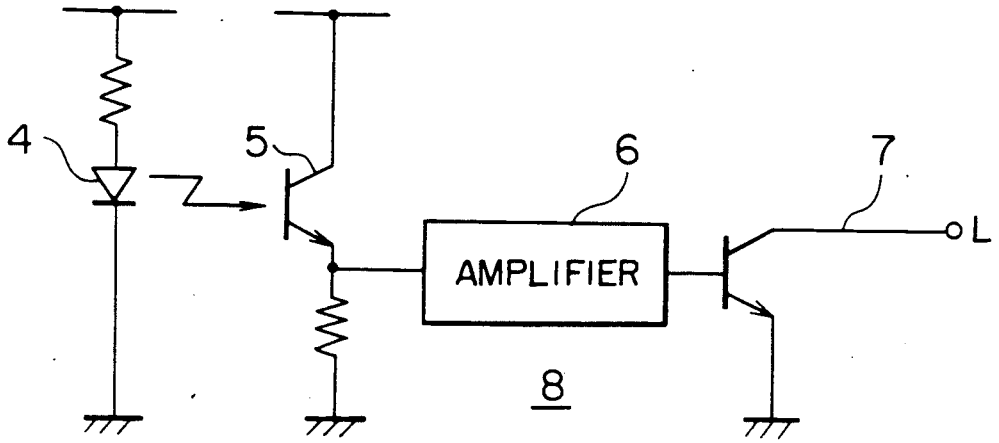
Figure 6:
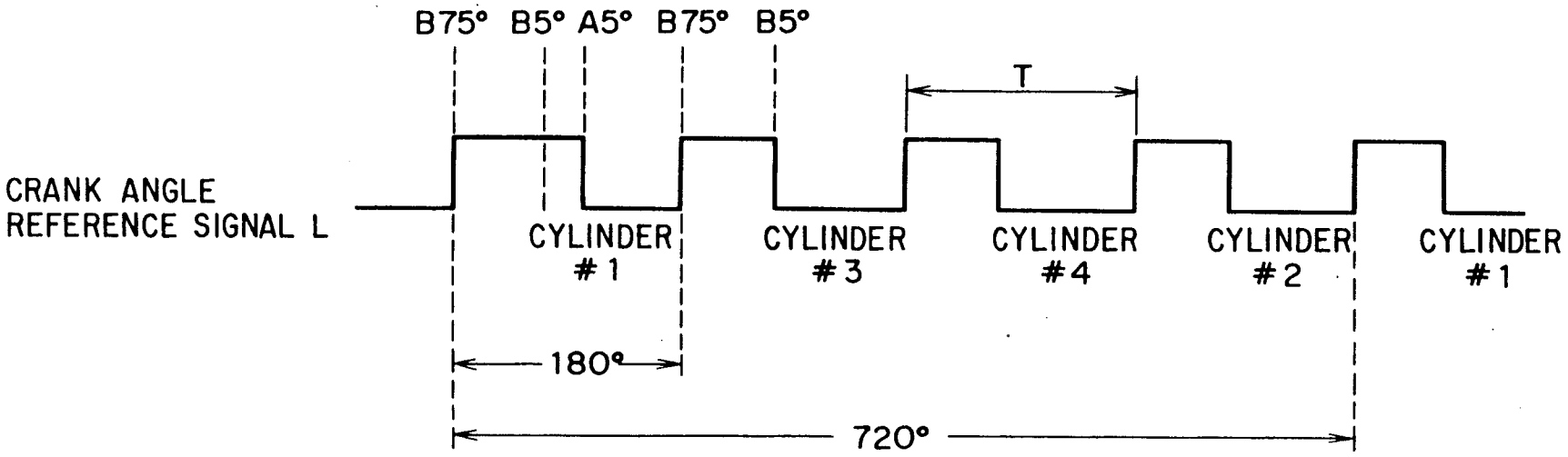
FIG. 6 shows a waveform of the position signal generated by the signal generator of FIGS. 4 and 5.
Figure 7:
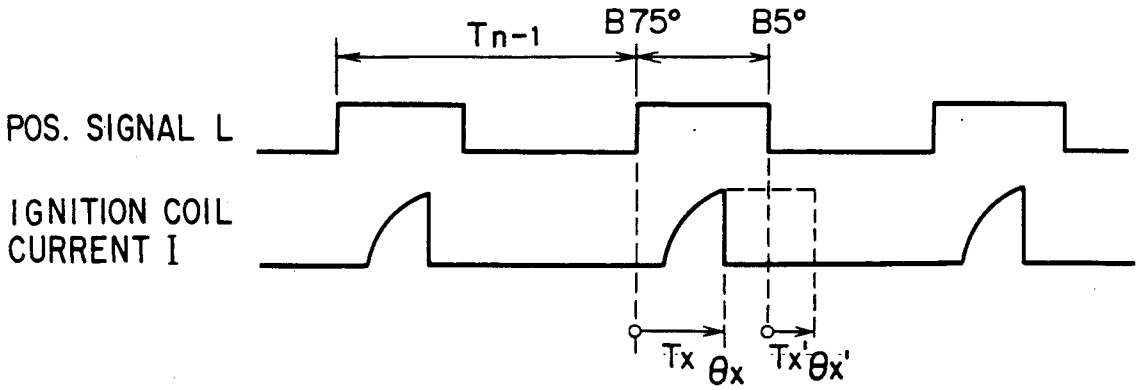
FIG. 7 shows the relation between the waveform of the position signal and the ignition current.

The control devices for a four-cylinder internal combustion engine according to the following embodiments of this invention have an organization as described above by reference to FIGS. 3 through 5. Thus, the overall organization thereof is as shown in FIG. 3, and the signal generator 8 has an organization as shown in FIGS. 4 and 5. Further, the signal generator 8 generates a crank angle reference position signal L whose waveform is as shown in FIG. 6, and the microcomputer 10 discriminates the particular cylinder, cylinder No. 1, from the ratio of the pulse-width to pulse-repetition period of the pulses of the signal L. For further details, reference is to be made to the description above by reference to FIGS. 3 through 6.

Figure 1:
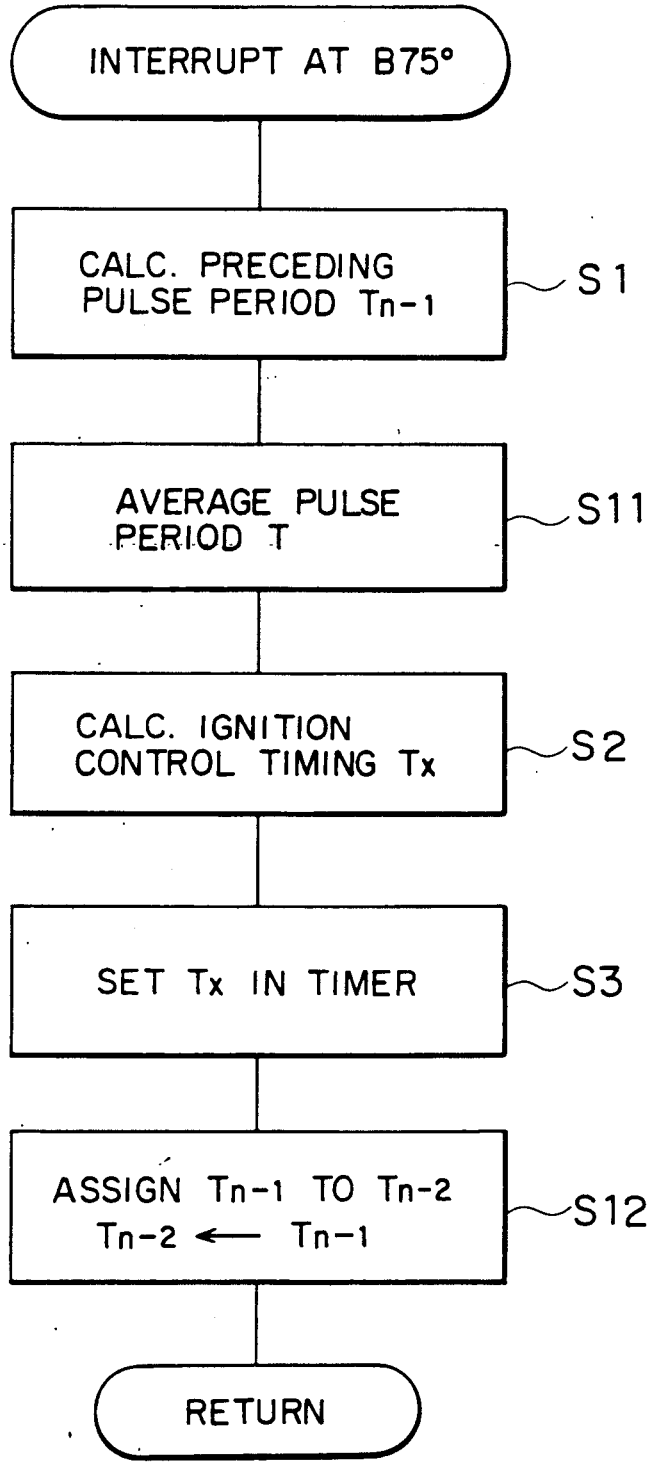
FIGS. 1 and 2 are flowcharts showing interrupt routines for controlling the ignition timings according to a first and second embodiment of this invention.

According to this invention, however, the time length Tx between the reference position of the crank angle and the target timing is determined in accordance with the average of two or more preceding pulse-repetition periods. Thus, according to a first embodiment of this invention, in the case where the first reference position B75° is utilized in the setting of the ignition timing, the microcomputer 10 executes an interrupt at every B75° and sets the time length Tx as shown in FIG. 1:

First, at step S1, the preceding pulse-repetition period $T_{n-1}$ of the position signal L is determined at each one of the first reference positions B75°. Further, at the subsequent step S11, the last two preceding pulse-repetition periods $T_{n-1}$ and $T_{n-2}$ are averaged. Namely, the second last pulse-repetition period $T_{n-1}$ preceding the last pulse-repetition period $T_{n-1}$ is stored in the memory of the computer 10 at a step S12, as described below. Thus, the average pulse-repetition period Ta is calculated from the last two preceding periods $T_{n-1}$ and $T_{n-2}$ as follows:

$$Ta=(T_{n-1}+T_{n-2})/2 \quad (3)$$

At the next step S2, the time length Tx from the first reference position B75° to the target ignition timing $\theta x$ is calculated by:

$$Tx=(\theta x-B75^\circ)\times Ta/180 \quad (4)$$

where Ta is the average period calculated by means of the equation (3) at step S11. At the following step S3, this time Tx is set in a timer in the microcomputer 10.

Finally, at step S12, the preceding pulse-repetition period $T_{n-1}$ is stored in the variable $T_{n-2}$ which stores the second last preceding pulse repetition period. Thus, the second last period $T_{n-2}$ is updated. The second last period $T_{n-2}$ is used in the calculation at step S11 as described above in the next interrupt routine.

By the way, when the second reference position B5 is utilized as the reference in the determination of the ignition timing, the length of time between the second reference position B5° and the target ignition timing $\theta x'$ is calculated, in accordance with the equation (2) above, as follows:

$$Tx'=(\theta x'-B5^\circ)Ta/180 \quad (5)$$

in a step corresponding to step S2 in an interrupt routine initiated at the second reference position B5°.

Figure 9:
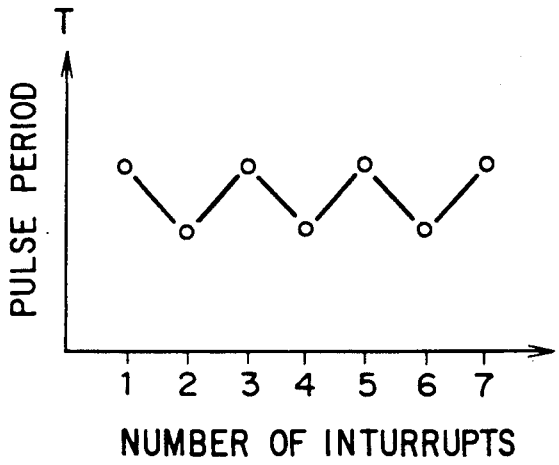
FIG. 9 shows the hunting of the pulse repetition period.
Figure 10:
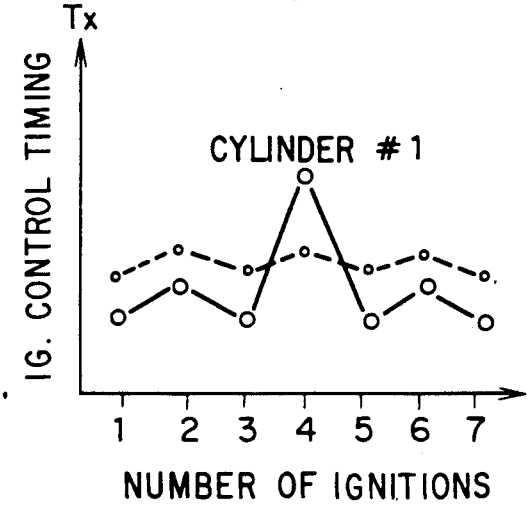
FIG. 10 shows the variation of the ignition timing occasioned by the hunting of the period as shown in FIG. 9.
Figure 8:
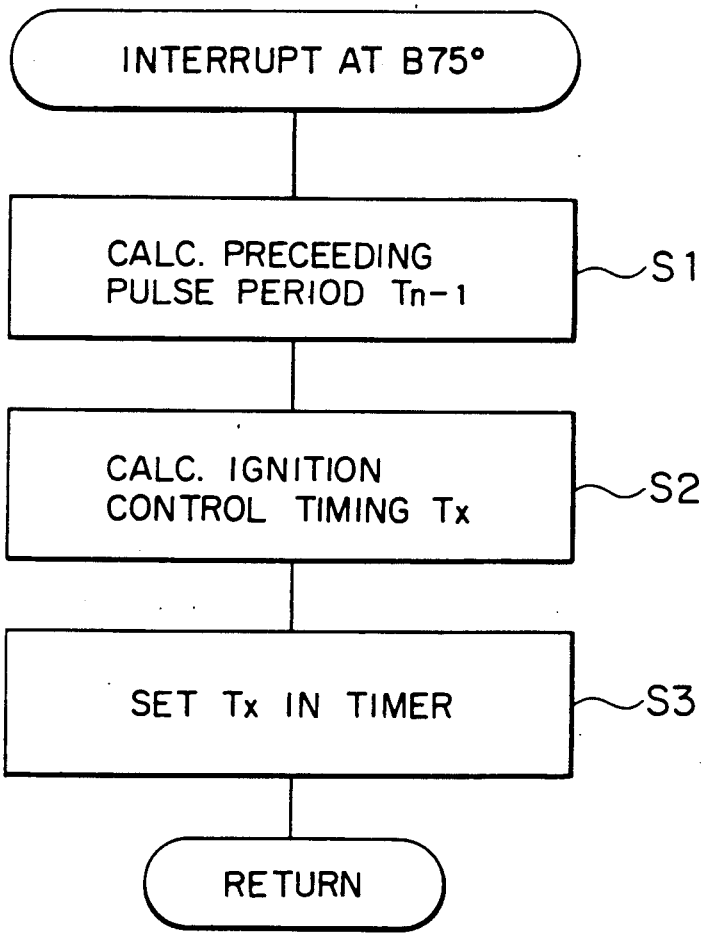
FIG. 8 is a flowchart showing the interrupt routine for controlling the ignition timings according to a conventional control method.

Thus, according to the embodiment, the time length Tx (or Tx') between the reference position and the ignition control timing is calculated utilizing the average Ta of the last two preceding periods $T_{n-1}$ and $T_{n-2}$. As a result, even when the pulse repetition period T undergoes hunting and rises and falls alternately as shown in FIG. 9, the time length Tx is substantially stable as shown by a dotted curve in FIG. 10. Thus, the error of the time length Tx, and therefore that of the ignition timing itself, is small. In particular, the error of the time length Tx of the particular cylinder (cylinder No. 1) does not become particularly conspicuous as shown by the dotted curve in FIG. 10.

There may arise a problem, however, with respect to the first embodiment, that the response of the ignition timing control is delayed during the transient time where an acceleration or deceleration of rpm of the engine occurs. It is therefore desirable to utilize the preceding period $T_{n-1}$ itself rather than the average period Ta during transient times, the utilization of the average period Ta being limited to during the stable rpm period.

Figure 2:
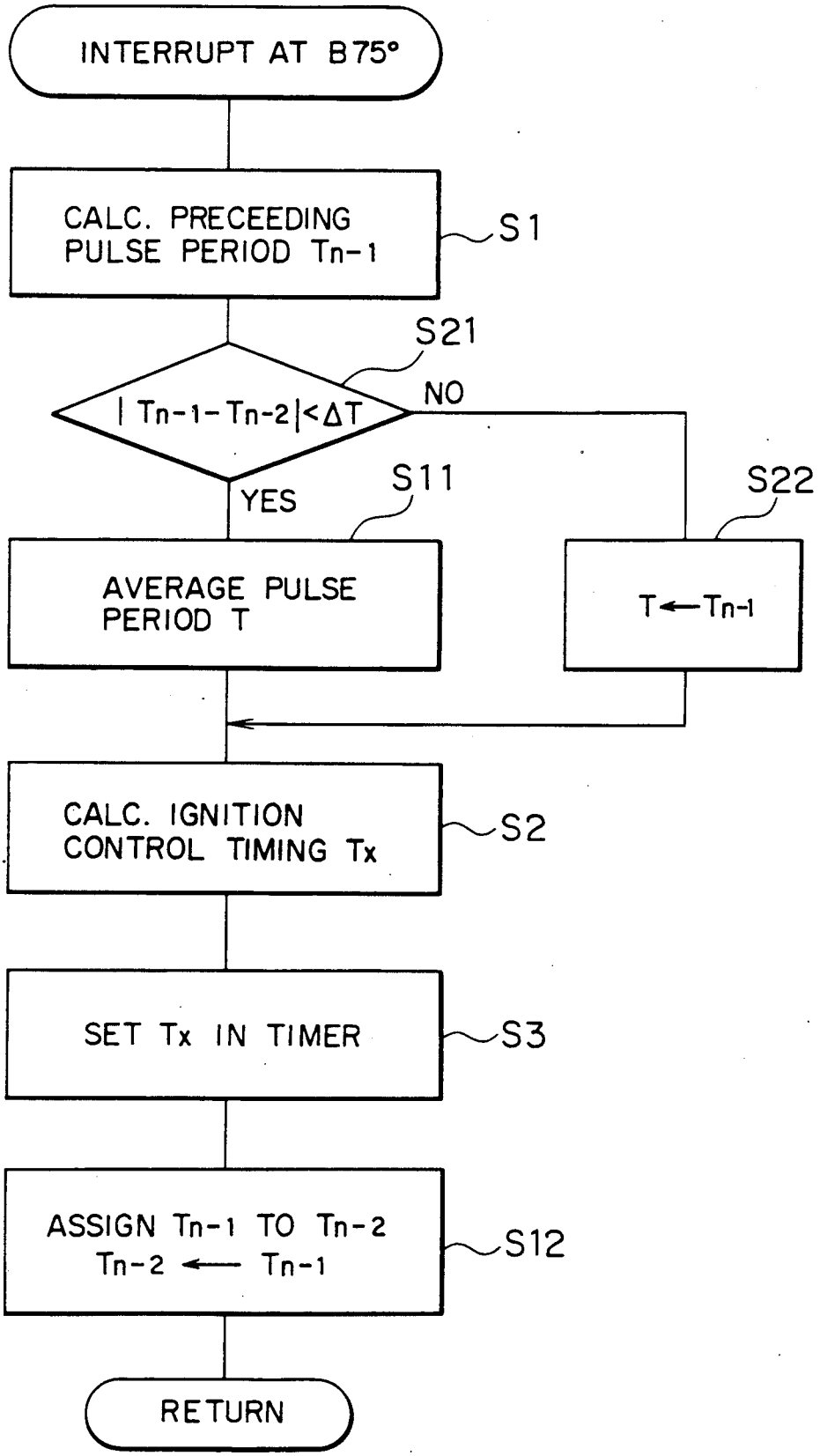

Thus, according to a second embodiment of this invention, the microcomputer 10 executes an interrupt at B75° as shown in FIG. 2, wherein steps S1 through S3 and S11 and S12 are similar to those designated by the same reference numerals in FIG. 1.

According to the second embodiment, after the preceding pulse period $T_{n-1}$ is calculated at step S1, the absolute value of the variation of the pulse period:

$$|T_{n-1}-T_{n-2}|$$

is calculated at step S21, where $T_{n-2}$ is the second last pulse period as stored in the step S12 in the preceding interrupt routine. Further, it is judged whether this absolute variation is less than a predetermined value $\Delta T$:

$$|T_{n-1}-T_{n-2}|<\Delta T$$

or not. This is also effected at step S21.

If the judgement at step S21 is affirmative, i.e., $$T_{n-1}-T_{n-1}|<\Delta T,$$

it is decided that the engine is in a stable operating condition, and the average Ta of the last two preceding pulse periods $T_{n-1}$ and $T_{n-2}$ is taken at step S11, as described above. Further, this average Ta is stored as the value of the pulse period T utilized at the subsequent step S2.

If the judgement at step S21 is negative, i.e., $$|T_{n-1}-T_{n-2}|\geqq\Delta T$$

it is decided that the engine is in a transient state, and, for the purpose of preventing the deterioration of the responsiveness of the ignition control, the value of the preceding pulse period $T_{n-1}$ is stored as the pulse period T utilized at the subsequent step S2.

At the subsequent step S2, the time length T between the first reference position B75° and the target ignition timing is calculated as follows:

$$Tx=(B75^\circ-\theta x)\times T/180$$

where T is the period as stored at step S11 or S22.

In the case where the second reference position B5° is utilized in the setting of the ignition timing, the time length Tx' between the second reference position and the ignition timing is determined by the equation (2) above.

Thus, according to the second embodiment, the time length Tx (or Tx') is calculated on the basis of the average pulse period Ta as determined by equation (4) or (5) during stable rpm period of the engine, and on the basis of the preceding pulse period $T_{n-1}$ as determined by the equation (1) or (2) during transient rpm period of the engine. As a result, the control error of the ignition timing resulting from the rpm hunting is suppressed during stable operation of the engine, and, at the same time, the deterioration of responsiveness during the transient operation of the engine is prevented.

The average of the last two pulse period $T_{n-1}$ and $T_{n-2}$ is taken at step S11 in the above embodiments. It goes without saying, however, that three or more preceding pulse periods may be averaged. In such case, the average Ta of k preceding pulse periods $T_{n-1}$, $T_{n-2}$. ---, $T_{n-k}$ is calculated by:

$$Ta=(T_{n-1}+T_{n-2}+\cdots+T_{n-k})/k$$

While description has been made of the particular embodiments of this invention, it will be understood that many modifications may be made without departing from the spirit thereof. The appended claims are contemplated to cover any such modifications as fall within the true spirit and scope of this invention.

What is claimed is:

1. A control device for a multi-cylinder internal combustion engine, comprising:

signal generator means for generating a position signal indicative of a crank angle reference position of respective cylinders of the multi-cylinder internal combustion engine;

period determining means, coupled to an output of said signal generator means, for determining a period between successive reference positions of respective cylinders;

memory means, coupled to said period determining means, for storing a period determined previously by the period determining means;

averaging means, coupled to said period determining means and said memory means, for taking an average of a period as determined by the period determining means and a period stored in the memory means;

updating means, coupled to said period determining means and said memory means, for updating the period stored in said memory means to the period lastly determined by the period determining means, each time after the average means takes said average;

ignition timing determining means, coupled to said averaging means, for determining, at each reference position of each cylinder, a length of time from the reference position to a target ignition timing in accordance with the average of the periods as determined by the averaging means; and ignition control means, coupled to said ignition timing determining means, for igniting said cylinder in accordance with the length of time from the reference position as determined by the ignition timing determining means.

2. A control device as claimed in claim 1, wherein said signal generator means generates a position signal indicative of a first and a second reference position of respective cylinders, and the second reference position of a particular cylinder has a retarding offset with respect to the second reference position of other cylinders, the control device discriminating the particular cylinder by means of said offset, wherein said period determining means determines a period between successive first reference positions or between successive second reference positions of respective cylinders.

3. A control device as claimed in claim 1, further comprising:

absolute variation calculation means, coupled to said period determining means and said memory means, for calculating an absolute value of a difference between the period as determined by the period determining means and the period stored in the memory means; and comparator means, coupled to said calculation means, for comparing said absolute value as calculated by the calculation means with a predetermined fixed value;

wherein said ignition timing determining means is coupled to said comparator means and said period determining means in addition to said averaging means, and determines the length of time between the reference position and the target ignition timing in accordance with the average of the periods as determined by the averaging means when said absolute value is less than said predetermined value, and in accordance with the preceding period as determined by the period determining means when said absolute value is not less than said predetermined value.

4. A control method for a multi-cylinder internal combustion engine by means of a control device including a signal generator for generating a position signal indicative of a first and a second reference crank angle position of respective cylinders, the second reference position of a particular cylinder having a retarding offset with respect to the second reference position of other cylinders, the control device discriminating the particular cylinder by means of said offset, said control method comprising the steps of:

(a) determining a period between successive first or second reference positions of respective cylinders;

(b) taking an average of at least two preceding periods as determined at step (a);

(c) determining, at each first or second reference position of each cylinder, a length of time from the first or the second reference position to a target ignition timing in accordance with the average of periods as determined at step (b); and (d) igniting each cylinder in accordance with the length of time from the first or the second reference position as determined at step (c).

5. A control method for a multi-cylinder internal combustion engine by means of a control device including signal generator for generating a position signal indicative of a first and a second reference crank angle position of respective cylinders, the second reference position of a particular cylinder having a retarding offset with respect to the second reference position of other cylinders, the control device discriminating the particular cylinder by means of said offset, said control method comprising the steps of:

(a) determining a period between successive first or second reference positions of respective cylinders;

(b) calculating an absolute value of the variation of two preceding periods as determined at step (a);

(c) comparing the absolute value as determined at step (b) with a predetermined fixed value;

(e) when the absolute value is less than the predetermined value in step (c), taking an average of at least two preceding periods as determined at step (a);

(f) determining, at each first or second reference position of each cylinder, a length of time from the first or the second reference position to a target ignition timing in accordance with the average of periods as determined at step (e) when said absolute value is less than the predetermined value, and in accordance with the preceding period as determined at step (a) when said absolute value is not less than the predetermined value; and (g) igniting each cylinder in accordance with the length of time from the first or the second reference position as determined at step (f).

* * * * *